US006932650B1

(12) United States Patent
Freitag

(10) Patent No.: US 6,932,650 B1
(45) Date of Patent: Aug. 23, 2005

(54) FUSED BATTERY TERMINAL CONNECTOR

(75) Inventor: Erik Freitag, Arlington Heights, IL (US)

(73) Assignee: Royal Die & Stamping Co., Inc., Bensenville, IL (US)

( * ) Notice: Subject to any disclaimer, the term of this patent is extended or adjusted under 35 U.S.C. 154(b) by 0 days.

(21) Appl. No.: 10/809,168

(22) Filed: Mar. 25, 2004

(51) Int. Cl.[7] ..... H01R 13/68
(52) U.S. Cl. ..... 439/621; 439/761; 337/188
(58) Field of Search ..... 439/621, 622, 439/754–774, 522; 429/178, 65, 121; 337/290, 337/5, 295, 142, 186–189

(56) References Cited

U.S. PATENT DOCUMENTS

| | | | | |
|---|---|---|---|---|
| 1,661,375 | A | 3/1928 | Leighton | |
| RE26,486 | E | 11/1968 | Haegert | |
| 3,568,138 | A | 3/1971 | Bakker | |
| 3,922,058 | A | 11/1975 | Kinnear | |
| 4,054,355 | A | 10/1977 | Kourimsky | |
| 4,063,794 | A | 12/1977 | Dittmann | |
| 4,126,367 | A | 11/1978 | Miller | |
| 4,354,726 | A | 10/1982 | Kato et al. | |
| 5,087,214 | A | 2/1992 | Dewar | |
| 5,120,617 | A * | 6/1992 | Cameron | 429/7 |
| 5,169,338 | A | 12/1992 | Dewar et al. | |
| 5,183,419 | A | 2/1993 | Dewar | |
| 5,221,219 | A | 6/1993 | Thomson | |
| 5,252,091 | A | 10/1993 | Fujita et al. | |
| 5,290,646 | A | 3/1994 | Asao et al. | |
| 5,302,142 | A | 4/1994 | Tabata | |
| 5,302,143 | A | 4/1994 | Inoue et al. | |
| 5,316,505 | A | 5/1994 | Kipp | |
| 5,346,407 | A | 9/1994 | Hood | |
| 5,389,466 | A | 2/1995 | Inoue et al. | |
| 5,431,580 | A | 7/1995 | Tabata | |
| 5,445,907 | A | 8/1995 | Ito et al. | |
| 5,454,741 | A | 10/1995 | Okada | |
| 5,466,164 | A | 11/1995 | Miyazaki et al. | |
| 5,486,119 | A | 1/1996 | Nabeshima et al. | |
| 5,486,123 | A | 1/1996 | Miyazaki | |
| 5,486,434 | A | 1/1996 | Aoyama | |
| 5,492,780 | A | 2/1996 | Okada | |
| 5,498,178 | A | 3/1996 | Tabata | |
| 5,599,210 | A | 2/1997 | Green | |
| 5,645,448 | A * | 7/1997 | Hill | 439/522 |
| 5,672,442 | A | 9/1997 | Burnett | |
| 5,711,688 | A | 1/1998 | Matsunaga et al. | |
| 5,733,152 | A | 3/1998 | Freitag | |
| 5,738,552 | A | 4/1998 | Halbach et al. | |
| 5,800,219 | A | 9/1998 | Siedlik et al. | |
| 5,805,047 | A * | 9/1998 | De Villeroche et al. | 337/290 |
| 5,879,202 | A | 3/1999 | Zhao | |
| 5,941,738 | A | 8/1999 | Matsunaga et al. | |
| 6,162,098 | A * | 12/2000 | Cheng et al. | 439/621 |

(Continued)

*Primary Examiner*—Gary Paumen
(74) *Attorney, Agent, or Firm*—Wallenstein, Wagner & Rockey, Ltd.

(57) ABSTRACT

A battery terminal connector having at least one ferrule at one end of the connector; a body portion at the other end of the connector; a generally flat base portion between the ferrule and the body portion; and a removable fuse, having two terminals, and positioned between the ferrule and the body portion. The connector preferably has an insulator positioned adjacent the generally flat base portion, a spindle arising from a generally flat panel upon which the insulator is positioned, and a clamping nut rotatably connectable onto the spindle.

22 Claims, 1 Drawing Sheet

U.S. PATENT DOCUMENTS 6,165,020 A * 12/2000 Cheng et al. ..... 439/621
6,250,973 B1 6/2001 Lowery et al.
6,294,978 B1 * 9/2001 Endo et al. ..... 337/166
6,509,824 B2 * 1/2003 Inaba et al. ..... 337/295
6,512,443 B1 * 1/2003 Matsumura et al. ..... 337/189
6,607,860 B2 * 8/2003 Hulbert et al. ..... 429/178
6,696,914 B2 * 2/2004 Haupt et al. ..... 337/295
6,723,920 B2 * 4/2004 Higuchi et al. ..... 174/50
6,764,353 B2 * 7/2004 Freitag ..... 439/763
6,806,421 B2 * 10/2004 Matsumura ..... 174/50

* cited by examiner

FUSED BATTERY TERMINAL CONNECTOR

DESCRIPTION

1. Technical Field

This invention is directed to a battery terminal connector that includes an easily accessible fuse. An insulating portion positioned near the base of the metallic connector permits a clamping nut to be handled by the individual changing the fuse without significant risk of shock. By keeping acids and other environmental contaminants from their surfaces, a flexible cover inhibits corrosion of both the connector and the fuse.

2. Background of the Invention

Electricity is necessary for the operation of most major powered systems and subsystems of modern motor vehicles. The electricity is stored in a common electrical storage battery. As the current is drawn from the electrical storage battery, that battery must be recharged. In virtually all modern motor vehicles, the battery is recharged by an alternator driven by a belt powered by the vehicle's engine.

The many electrical circuits, or the cables that can be a part of those circuits, are typically protected by fuses and fusible links. Some of these fuses are contained within and protected by novel structures, such as those described and claimed in the assignee's co-pending U.S. patent application Ser. No. 10/679,732, entitled "Fuse Holder with Adjustable Terminals", and filed on Oct. 6, 2003. Other such fuses may be located in remote fuse boxes. Finally, still other such fuses can be placed directly inside of, i.e., contained within, the wires or cables to be protected.

An example of this latter structure is the cable that is typically placed between the positive or negative terminal of the storage battery and the alternator. When an overvoltage or overcurrent situation occurs, and as a result, the in-line fuse of this battery-to-alternator cable blows, the car must be immediately serviced. Because the fuse is contained entirely within the damaged cable, it is not accessible by the vehicle owner, and cannot be replaced. The inability to see or gain access to the fuse prevents the owner from visually establishing that the fuse has in fact blown. Thus, such service can normally be accomplished only by towing the vehicle to a service or repair facility.

In some vehicles, the cable that is placed between the positive or negative terminal of the battery and the alternator does not have a fuse that is contained within that cable. Rather, the fuse that protects this cable is connected to one end of that cable. That fuse is permanently secured to a fuse holder having two ends. The fuse holder is typically made of a rigid, electrically conductive material, such as copper or a copper alloy. The two end terminals of this fuse holder may be disposed directly opposite each other at a relative angle of 180°, or they may be offset relative to each other, at various acute or obtuse angles, depending upon the needs of the vehicle manufacturer, and the configurations and underhood spacing of the vehicles produced by that manufacturer. Many different fuse holder configurations, with various angles between their two end terminals, are necessary to satisfy the various needs of these manufacturers. Moreover, as a result of the permanent securement of the fuse to this fuse holder, replacement of a blown fuse requires replacement of the entire fuse holder assembly. The permanent securement of the fuse to the fuse holder prevents the replacement of the fuse alone.

Accordingly, there is a need for an improved fuse holder that will solve these deficiencies with the various above-described prior art fuse holders.

SUMMARY OF THE INVENTION

The invention is a battery terminal connector. The connector includes at least one ferrule at one end of the connector, and a body portion, preferably at the other end of the connector. Between the ferrule and the body portion is a generally flat base portion. The connector is designed to accommodate, at the generally flat base portion, a removable fuse. Like most electrical and electronic fuses, this removable fuse has two terminals. An insulator is positioned adjacent the generally flat base portion of the connector. This insulator permits a clamping nut to be handled by the individual changing the fuse with a lowered risk of shock. A flexible, substantially form-fitting cover extends over the battery terminal connector so as to protect that connector from battery acid and corrosion. The bottom of that form-fitting cover preferably abuts against the case of the battery to which the battery terminal connector is secured.

In another aspect of the invention, a spindle arises from the generally flat base upon which the insulator is positioned. Preferably, the spindle and the insulator are integrally secured to a bracket. It is also preferable that the bracket has a generally C-shaped profile, and that the bracket is made of an insulating material.

The most preferred insulating material is a polymer, and the most preferred polymer is polypropylene.

The present invention is a battery terminal connector which provides easy access to the fuse by the vehicle owner, and which fuse is not contained entirely within the damaged cable. The invention also is a battery terminal connector which enables the fuse to be replaced by the vehicle owner. A still further advantage of the invention is that the connector permits the vehicle owner to readily see the fuse, and thereby establish whether the fuse has in fact blown. Thus, the present invention permits the owner to engage is such replacement, in the event that the owner's visual inspection of that fuse confirms that the fuse has blown. This eliminates the need for the owner to drive or tow his vehicle to a service or repair facility. Moreover, by virtue of his ability to ascertain the nature of the problem, and to quickly and easily remedy that problem, the vehicle owner can avoid being stranded in an inoperable vehicle. Unlike some prior art devices, which permanently secure a fuse to a fuse holder, replacement of a blown fuse can be readily accomplished without replacement of the entire fuse/fuse holder assembly.

Accordingly, the present fused battery terminal connector will solve some of the deficiencies of certain prior art, competitive devices.

DETAILED DESCRIPTION

There are many possible embodiments of this invention. The drawings and description below describe in detail two preferred embodiments of the invention. It should be understood that the present disclosure is to be considered as an example of the principles of the invention. The disclosure is not intended to limit the broad aspect of the invention to the illustrated embodiments.

Figure 1:
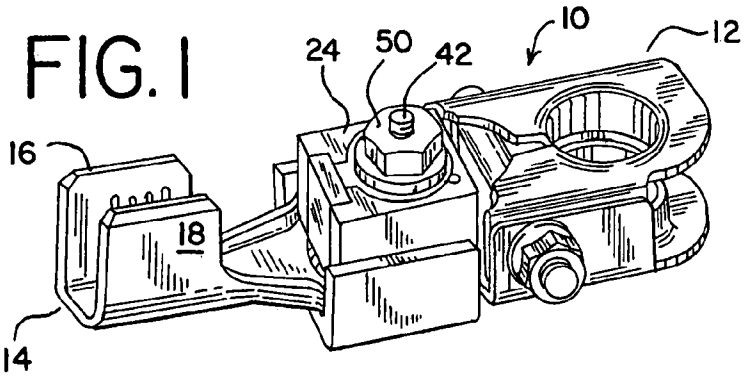
FIG. 1 is a perspective view of one embodiment of a fused battery terminal connector of the invention.

Referring now to FIG. 1, the invention is a battery terminal connector 10. The connector 10 includes a body portion 12 at one of its lateral ends and a grip or ferrule 14 at its opposite lateral end. The body portion 12 is fitted over either the negative (–) or positive (+) frusto-conical shaped terminal post (not shown) of a twelve-volt automotive storage battery.

The grip or ferrule 14 is adapted for connecting and securing the battery cable (not shown) to the connector 10. Particularly, a portion of insulation adjacent one end of the battery cable is removed, exposing the underlying copper core of the cable. The exposed end of the battery cable is placed onto the ferrule 14, and the opposing wings 16 and 18 of the ferrule 14 are crimped over the copper core. As a result of this crimping, the exposed end of the battery cable is gripped tightly by the ferrule 14. In this way, electrical current can travel, for example, from the positive (+) battery post of the automotive storage battery, through the battery cable, and to the starter motor of the vehicle.

The construction of some portions of the novel battery terminal connector 10 shown in FIG. 1 is similar to the construction of battery terminal connectors of the prior art. The details of such construction are disclosed in some detail in the specification of the co-pending U.S. application Ser. No. 10/177,289 of the assignee, and of assignee's already issued U.S. Pat. No. 5,733,152. The disclosures of that application and that patent are incorporated by reference into this specification.

Figure 4:
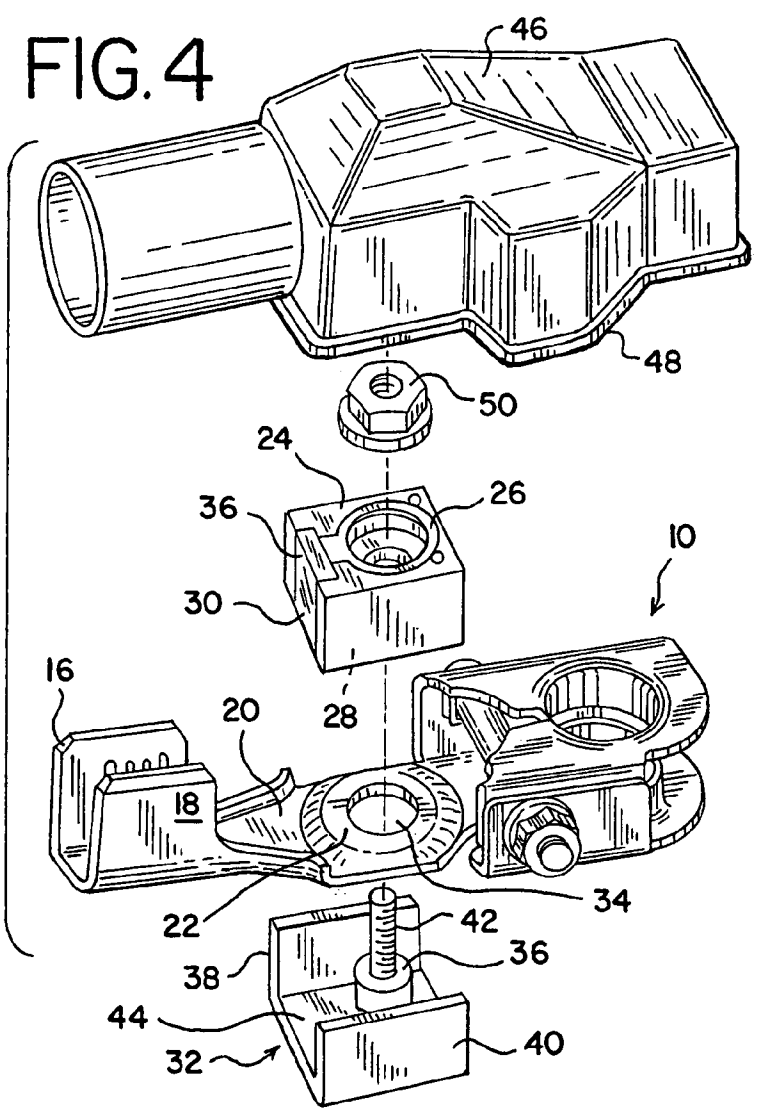
FIG. 4 is an exploded view of a second embodiment of the fused battery terminal connector, with a bracket that is not permanently connected to the connector, but is instead removable through a friction fit relationship to the connector, and further showing a generally flexible protective cover.
Figure 3:
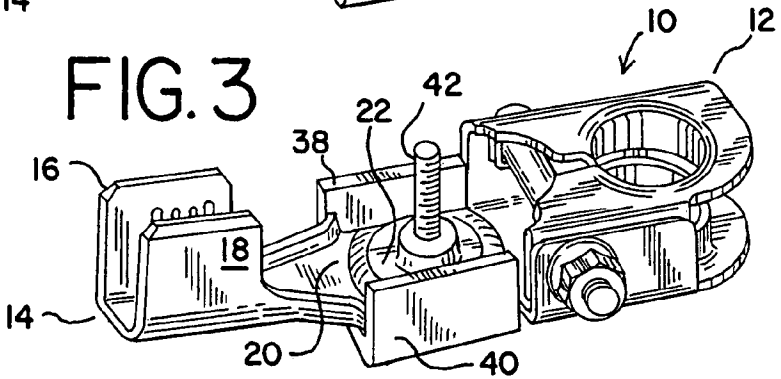
FIG. 3 is a perspective view of the first embodiment of the connector of FIG. 2, but after removal of the fuse that rests near the base of connector.

Referring now to FIGS. 3 and 4, the area between the ferrule 14 and the body portion 12 includes a generally flat base portion 20. The generally flat base portion 20 may have, as shown in shaded regions of FIGS. 3 and 4, a slightly convex portion 22.

Figure 2:
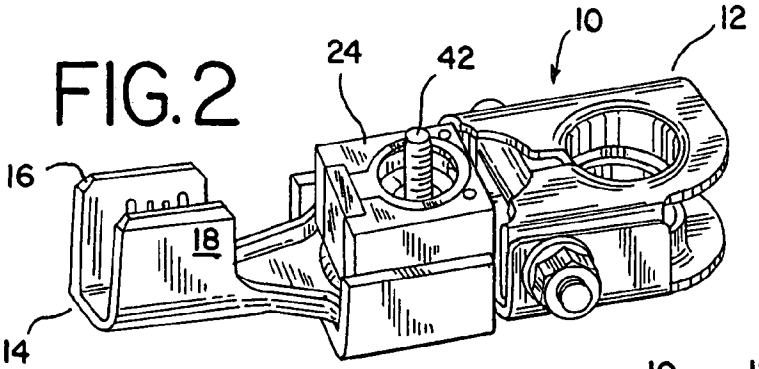
FIG. 2 is a view of the fused battery terminal connector of FIG. 1, but without the threaded fastener or clamping nut that retains the fuse upon the base of the connector.

The battery terminal connector 10 is designed to accommodate, at the generally flat base portion 20, a removable fuse 24. This removable fuse 24 is depicted in FIGS. 1, 2 and 4. Like most electrical and electronic fuses, this removable fuse has two metal terminals, 26 and 28. Terminal 26 is at the top of the fuse 24, and is shown in FIGS. 1, 2, and 4. In contrast, terminal 28 is not shown; terminal 28 is essentially identical to terminal 26, and is on the diametrically opposite side or bottom of the cube-shaped removable fuse 24.

The removable fuse 24 also includes a fusible link 30, and the removable fuse 24 is typically rated at one hundred and seventy-five (175) amperes. The fusible link 30 is protected by a transparent window 36 that permits the vehicle owner to assess the condition of the fuse 24. When the fusible link 30 is in its normal, conducting condition, the window 36 is clear, and the fusible link 30 exhibits its original bright silver metallic color. In contrast, when the fusible link 30 has blown due to overcurrent or overvoltage conditions in the protected circuit, the fusible link 30 and the window 36 are usually darkened, and the darkened window 36 may obscure the ability to see the severed, discolored fusible link 30. Whether or not the severed fusible link 30 can be seen by the vehicle owner or a service technician, the darkened condition of the window 36 or the fusible link 30 conclusively establishes that the fuse 24 has blown, and needs to be removed and replaced with a new fuse.

The fusible link 30 is electrically connected to terminals 26 and 28. Electrical current passes into the fusible link 30 through terminal 26, and out of fusible link 30 through terminal 28.

FIG. 3 shows one most preferred embodiment of the connector 10 of the invention. In this embodiment, the C-shaped bracket 32 is integrally attached to, or formed with, the connector 10, and is constructed so as to be essentially inseparable from the connector 10.

FIG. 4 shows a second embodiment of the connector 10 of the invention. In this embodiment, one may see the C-shaped bracket 32 separated from the battery terminal connector 10. As may be seen through a comparison of FIG. 3 and FIG. 4, in the embodiment of FIG. 4, the separate C-shaped bracket 32 is connected to the battery terminal connector 10 by passing a threaded spindle 42 through an orifice 34.

In the embodiments of both FIGS. 3 and 4, this orifice 34 is positioned at the center of the convex portion 22. In both embodiments, the bracket 32 must be made of an insulating material. The preferred insulating material is a petroleum based polymer, and the most preferred polymer is polyethylene.

In the embodiments of both FIGS. 3 and 4, the C-shaped bracket 32 includes an insulator 36. The insulator 36 has a generally cylindrical shape. The insulator 36 is a part of, and is integrally formed with, the C-shaped bracket 32. As a result, like the C-shaped bracket 32, the insulator 36 is also made of polyethylene.

In the embodiment of FIG. 4, when the C-shaped bracket 32 and connector 10 are brought into engagement with each other, they are tightly held together by virtue of a friction fit. Because of this friction fit, no fasteners are necessary to retain the connector 10 with the C-shaped bracket 32 of FIG. 4.

This friction fit of the embodiment of FIG. 4 results from two main factors. The first of these factors is a tight fit between orifice 34 and insulator 36. The second of these factors is a relatively tight fit between the vertically disposed walls 38 and 40 of the C-shaped bracket 32 and the sides of the flat base portion 20 of the battery terminal connector 10.

As may also best be seen in the embodiments of both FIGS. 3 and 4, threaded spindle 42 is molded into the C-shaped bracket 32, in a manner well-known in the art. Unlike the C-shaped bracket 32, the threaded spindle 42 is made of a conducting material, preferably a metal material. The spindle 42 arises from the generally flat support panel 44 of the bracket 32 upon which the insulator 36 is also positioned. The integral securement of the spindle 42 and the insulator 36 to the bracket may best be seen in FIG. 3.

As may best be seen from FIGS. 1 and 4, a threaded clamping nut 50 may be secured to the threaded spindle 42 to retain the removable fuse 24 to the battery terminal connector 10. If the vehicle owner or service technician discovers through a visual inspection that the fuse 24 has blown, the threaded nut 50 may be easily removed, the blown fuse 24 may be removed, and replaced with a new fuse, and the threaded nut 50 may be replaced onto the spindle 42 to secure the new fuse in place.

The insulator 36 is positioned adjacent the generally flat base portion 20 of the connector 10 to prevent contact between the generally flat base portion 20 (including the convex portion 22) and the spindle 42. As a result, no current may pass from the connector 10 into the spindle 42. This is important, for as may be seen in FIG. 1, the threaded clamping nut 50 is threadably engaged to the spindle 42. Thus, any current that would pass through the spindle 42 could also pass through the threaded clamping nut 50. It follows that because the insulator 36 prevents current from passing into the spindle 42, no current can pass through the threaded clamping nut 50. In this way, when a user through visual inspection determines that the removable fuse 24 needs to be replaced, he may grasp the threaded clamping nut 46 and ordinarily not be subjected to electrical shock.

For additional assurances against electrical shock, this threaded clamping nut 50 can be made of a non-conductive material, such as a plastic or rubber. For still additional assurance against electrical shock, the threaded clamping nut 50 can be a non-conductive cap-type screw, which when engaged with the spindle 42, covers the top of that spindle 42.

A flexible, substantially form-fitting cover 46 extends over the battery terminal connector 10 so as to protect that connector 10 from battery acid and corrosion. The bottom 48 or skirt of that form-fitting cover 46 preferably abuts against the case of the automotive storage battery to which the battery terminal connector 10 is secured.

The fuse 24 can protect any of a number of different vehicle electrical components. One example of such a component is the power distribution box. An insulated conducting cable, having at one of its ends a circular terminal or eyelet (not shown), permits the flow of electrical current between the connector 10 and the power distribution box. The ring-shaped eyelet is sized so that it lays flat upon and engages the entire top surface of terminal 26. The eyelet is secured to the terminal 26 by the threaded clamping nut 50.

Accordingly, it may be appreciated from the above description that the present invention is a device which provides easy access by the vehicle owner to a fuse that, in prior art devices, is often inaccessible. In the present invention, it is apparent that the fuse is not contained entirely within a cable. As a result, the invention enables the fuse to be readily replaced by the vehicle owner or a service technician.

It may also be appreciated from the above description that the present invention permits the vehicle owner to readily see the fuse, and thereby visually establish that the fuse has in fact blown. Thus, the present invention permits the owner to engage is such replacement, in the event that the owner's visual inspection of that fuse establishes that the fuse has blown. This eliminates the need for the owner to drive or tow his vehicle to a service or repair facility. Moreover, by virtue of his ability to ascertain the nature of the problem, and to quickly and easily remedy that problem, the vehicle owner can avoid being stranded in an inoperable vehicle. Unlike some prior art devices, which provide for permanent securement of a fuse or fusible link to a cable, replacement of a blown fuse can be readily accomplished without replacement of the entire fuse/cable assembly.

It is understood that, given the above description of the embodiments of the invention, various modifications may be made by one skilled in the art. Such modifications are intended to be limited only by the scope of the below claims.

What is claimed is:

1. A battery terminal connector, the connector including at least one crimp ferrule at one end of the connector; a body portion adapted to be seated over a battery post and integral with the crimp ferrule; a generally flat base portion between the ferrule and the body portion; and a removably-mounted fuse, having two terminals, and positioned between the ferrule and the body portion.

2. The battery terminal connector of claim 1, further comprising an insulator; a spindle arising from the insulator; and a clamping nut rotatably connectable onto the spindle, wherein the insulator permits the clamping nut to be handled by the individual changing the fuse with a lowered risk of shock.

3. The battery terminal connector of claim 2, wherein the spindle and the insulator are integrally secured to a bracket.

4. The battery terminal connector of claim 3, wherein the bracket has a generally C-shaped profile.

5. The battery terminal connector of claim 4, wherein the bracket is made of an insulating material.

6. The battery terminal connector of claim 5, wherein the insulating material is a polymer.

7. The battery terminal connector of claim 6, wherein the polymer is polypropylene.

8. A battery terminal connector, the connector including at least one crimp ferrule at one end of the connector; a body portion at the other end of the connector and adapted to be seated over a battery post and integral with the crimp ferrule; a generally flat base portion between the ferrule and the body portion, the flat base being suitable for receiving a removable fuse between the ferrule and the body portion; and a removable fuse having two terminals and positioned on that base.

9. The battery terminal connector of claim 8, further comprising an insulator positioned adjacent the generally flat base portion.

10. The battery terminal connector of claim 9, further comprising a spindle arising from the insulator.

11. The battery terminal connector of claim 10, wherein the spindle and the insulator are integrally secured to a bracket.

12. The battery terminal connector of claim 11, wherein the bracket has a generally C-shaped profile.

13. The battery terminal connector of claim 12, wherein the bracket is made of an insulating material.

14. The battery terminal connector of claim 13, wherein the insulating material is a polymer.

15. The battery terminal connector of claim 14, wherein the polymer is polypropylene.

16. A battery terminal connector, the connector including at least one crimp ferrule at one end of the connector; a body portion at the other end of the connector and adapted to be seated over a battery post and integral with the crimp ferrule; a generally flat base portion between the ferrule and the body portion; a removable fuse, having two terminals, and positioned between the ferrule and the body portion; an insulator positioned adjacent the generally flat base portion; and a flexible, substantially form-fitting cover which extends over the battery connector so as to protect the battery connector from battery acid and corrosion.

17. The battery terminal connector of claim 16, further comprising a spindle arising from the generally flat base portion upon which the insulator is positioned.

18. The battery terminal connector of claim 17, wherein the spindle and the insulator are integrally secured to a bracket.

19. The battery terminal connector of claim 18, wherein the bracket has a generally C-shaped profile.

20. The battery terminal connector of claim 18, wherein the bracket is made of an insulating material.

21. The battery terminal connector of claim 20, wherein the insulating material is a polymer.

22. The battery terminal connector of claim 21, wherein the polymer is polypropylene.

* * * * *